US012138690B2

(12) United States Patent
Egashira et al.

(10) Patent No.: US 12,138,690 B2
(45) Date of Patent: Nov. 12, 2024

(54) SINTERED MATERIAL AND METHOD OF MANUFACTURING SINTERED MATERIAL

(71) Applicants: SUMITOMO ELECTRIC INDUSTRIES, LTD., Osaka (JP); SUMITOMO ELECTRIC SINTERED ALLOY, LTD., Okayama (JP)

(72) Inventors: Shigeki Egashira, Osaka (JP); Takayuki Tashiro, Osaka (JP); Tomoyuki Ishimine, Osaka (JP); Kosuke Tominaga, Osaka (JP)

(73) Assignees: SUMITOMO ELECTRIC INDUSTRIES, LTD., Osaka (JP); SUMITOMO ELECTRIC SINTERED ALLOY, LTD., Okayama (JP)

( * ) Notice: Subject to any disclaimer, the term of this patent is extended or adjusted under 35 U.S.C. 154(b) by 57 days.

(21) Appl. No.: 17/047,206

(22) PCT Filed: Jan. 30, 2019

(86) PCT No.: PCT/JP2019/003262
§ 371 (c)(1),
(2) Date: Oct. 13, 2020

(87) PCT Pub. No.: WO2020/157880
PCT Pub. Date: Aug. 6, 2020

(65) Prior Publication Data

US 2021/0162498 A1 Jun. 3, 2021

(51) Int. Cl.
*B22F 5/08* (2006.01)
*B22F 1/00* (2022.01)
(Continued)

(52) U.S. Cl.
CPC ..... *B22F 5/08* (2013.01); *B22F 1/09* (2022.01); *B22F 1/142* (2022.01); *B22F 3/12* (2013.01);
(Continued)

(58) Field of Classification Search
CPC ..... B22F 3/12; B22F 3/16–168
See application file for complete search history.

(56) References Cited

U.S. PATENT DOCUMENTS 3,897,618 A * 8/1975 Church ..... B22F 3/17 419/48
4,069,044 A * 1/1978 Mocarski ..... C22C 33/0264 75/243
(Continued)

FOREIGN PATENT DOCUMENTS

CN 104593693 5/2015
GB 1378844 A * 12/1974 ..... B22F 3/02
(Continued)

OTHER PUBLICATIONS

"Figure 2-6 Pyron iron powder production process", F.V. Reiner, "Powder Metallurgy Principles and Applications", Metallurgical Industry Press, pp. 21-22, Nov. 30, 1989 (With Concise English Explanation).

*Primary Examiner* — Alexandra M Moore
*Assistant Examiner* — Austin Pollock
(74) *Attorney, Agent, or Firm* — IPUSA, PLLC

(57) ABSTRACT

A sintered material includes a composition composed of iron-based alloy, and a texture containing 200 or more and 1350 or less of compound particles having a size of 0.3 μm or more per unit area of 100 μm×100 μm in a cross section, and a relative density is 93% or more.

4 Claims, 4 Drawing Sheets

(51) Int. Cl.

| | |
|---|---|
| ***B22F 1/142*** | (2022.01) |
| ***B22F 3/12*** | (2006.01) |
| ***B22F 3/24*** | (2006.01) |
| ***C21D 9/32*** | (2006.01) |
| ***C22C 33/02*** | (2006.01) |
| ***C22C 38/00*** | (2006.01) |

(52) U.S. Cl.

CPC ..... *C21D 9/32* (2013.01); *C22C 33/0207* (2013.01); *C22C 33/0264* (2013.01); *C22C 38/00* (2013.01); *B22F 2003/247* (2013.01); *B22F 2201/32* (2013.01); *B22F 2301/35* (2013.01); *B22F 2302/40* (2013.01); *B22F 2304/05* (2013.01); *B22F 2998/10* (2013.01)

(56) References Cited

U.S. PATENT DOCUMENTS 4,253,874 A * 3/1981 Cundill ..... C22C 38/18 419/33
4,266,974 A * 5/1981 Nitta ..... C22C 33/0257 420/128
6,485,540 B1 * 11/2002 Kosco ..... C22C 33/02 75/343
2002/0048526 A1 * 4/2002 Nakamura ..... C22C 33/0264 419/57
2003/0070508 A1 4/2003 Ozaki et al.
2003/0143097 A1 * 7/2003 Nakamura ..... B22F 3/1007 419/57
2005/0084406 A1 * 4/2005 Ohtsuka ..... C21D 6/002 148/514
2005/0109157 A1 * 5/2005 Toyoshima ..... C22C 38/08 75/255
2007/0089562 A1 * 4/2007 Unami ..... C22C 33/0207 75/255
2010/0278681 A1 * 11/2010 Bengtsson ..... C22C 33/0207 420/104
2012/0085201 A1 * 4/2012 Kawano ..... B22F 1/10 75/252
2013/0236349 A1 * 9/2013 Guo ..... B22F 3/12 419/19
2015/0033894 A1 * 2/2015 Okuno ..... B22F 5/08 419/29
2015/0114178 A1 4/2015 Ishigami et al.
2017/0369977 A1 * 12/2017 Ueno ..... C22C 38/00
2018/0236548 A1 8/2018 Ishimine et al.

FOREIGN PATENT DOCUMENTS

JP H04-173901 6/1992
JP 2002-146402 5/2002
JP 2002-317204 10/2002
JP 2003147405 A * 5/2003
JP 2006233331 A * 9/2006
JP 2008-038160 2/2008
JP 2009203535 A * 9/2009
JP 2017-186625 10/2017
JP 2017206753 A * 11/2017

* cited by examiner

SINTERED MATERIAL AND METHOD OF MANUFACTURING SINTERED MATERIAL

TECHNICAL FIELD

The present disclosure relates to a sintered material and a method of manufacturing a sintered material.

BACKGROUND ART

Patent Document 1 discloses a sintered material having a relative density of 93% or more.

PRIOR ART DOCUMENTS

Patent Documents

Patent Document 1: Japanese Laid-Open Patent Application Publication No. 2017-186625

SUMMARY OF THE INVENTION

A sintered material of the present disclosure includes:
- a composition composed of iron-based alloy; and
- a texture containing 200 or more and 1350 or less of compound particles having a size of 0.3 μm or more per unit area of 100 μm×100 μm in a cross section,
- wherein a relative density is 93% or more.

A method of manufacturing a sintered material of the present disclosure, includes steps of:
- preparing a raw material powder containing an iron-based powder;
- producing a powder compact having a relative density of 93% or more using the raw material powder; and
- sintering the powder compact,
- wherein the iron-based powder contains at least one of a powder made of pure iron and a powder of iron-based alloy,
- wherein the step of preparing raw material powder includes a step of reducing the iron-based powder, and
- wherein the step of reducing the iron-based powder includes a step of heating the iron-based powder up to a range of 800° C. or more and 950° C. or less in a reduced atmosphere.

PROBLEMS TO BE SOLVED BY THE DISCLOSURE

Figure 1A:
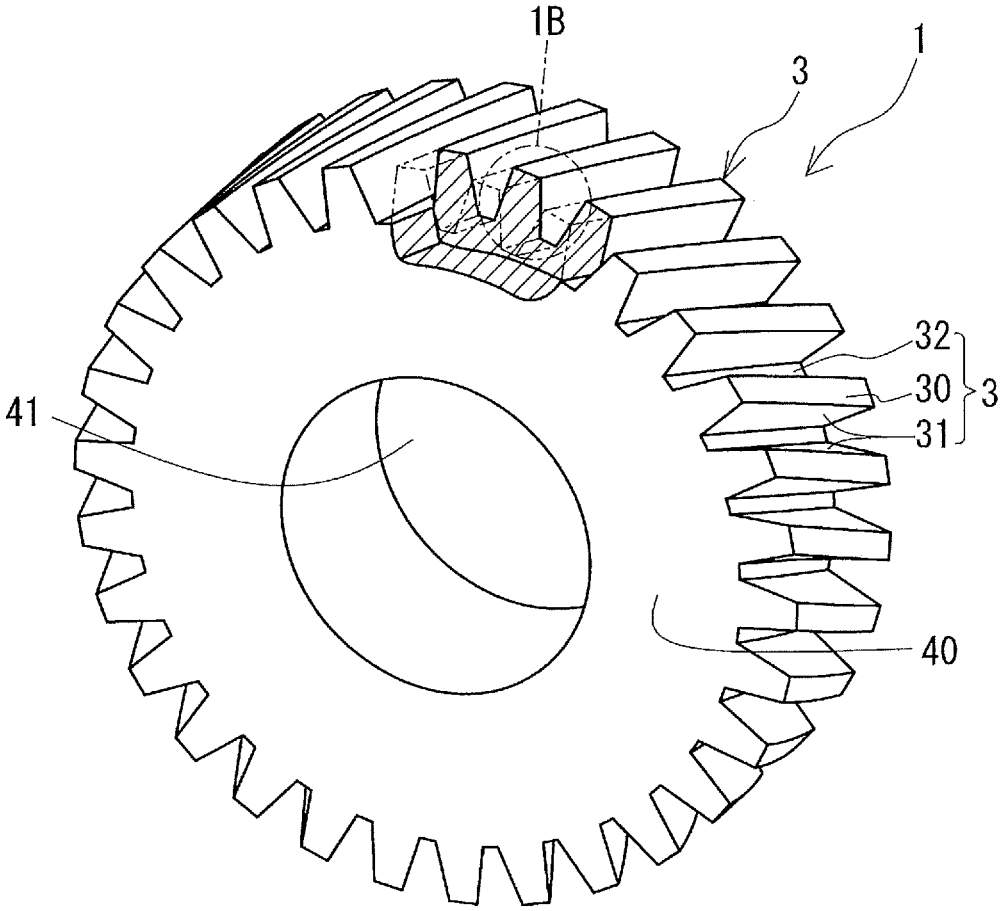
FIG. 1A is a schematic perspective view illustrating an example of a sintered material according to an embodiment.

For an iron-based sintered material, further improvement of strength is desired.

In a sintered material, a hole is usually a starting point for cracking, which causes a decrease in strength, such as tensile strength. However, the present inventors have found that in a dense sintered material with a relative density of 93% or more, a compound particle that may be present in the sintered material, rather than the hole, becomes the cracking point and decreases the tensile strength.

Therefore, one object of the present disclosure is to provide a sintered material with excellent strength. Another object of the present disclosure is to provide a method for manufacturing a sintered material capable of manufacturing a sintered material having excellent strength.

Effect of the Disclosure

The sintered material of the present disclosure has excellent strength. The method of manufacturing a sintered material according to the present disclosure can manufacture a sintered material having excellent strength.

DESCRIPTION OF EMBODIMENTS OF THE PRESENT DISCLOSURE

To begin with, embodiments of the present disclosure will be listed and described.

(1) A sintered material according to one embodiment of the present disclosure includes:
- a composition composed of iron-based alloy; and
- a texture containing 200 or more and 1350 or less of compound particles having a size of 0.3 μm or more per unit area of 100 μm×100 μm in a cross section,
- wherein a relative density is 93% or more.

The sintered material of the present disclosure has high tensile strength, and is excellent in strength in this regard. One reason for this is that the sintered material of the present disclosure is a dense sintered material having a relative density of 93% or more. Moreover, one of the other reasons is that in the sintered material of the present disclosure, compound particles (e.g., oxides, sulfides, nitrides) having a size of 0.3 μm (300 nm) or more are present at least on the surface of the sintered material within the above-described specific range. For the dense sintered material described above, compound particles of 0.3 μm or more can be the starting point for cracking. Moreover, if there are excessive compound particles greater than 0.3 μm, these compound particles will propagate cracks. The tensile strength of the sintered material is likely to decrease due to the occurrence of cracks and the propagation of cracks. In this regard, the present inventors have found that if compound particles of 0.3 μm or more are present in at least the surface layer of the sintered material within the above-described specific range, the tensile strength of the sintered material can be improved. One possible reason for this is that dispersion of a suitable amount of the compound particles in the sintered material prevents coarse crystal grains (e.g., formerly austenitic grains). Because the coarseness of the crystal grain is reduced at least in the surface layer of the sintered material, it is considered that the surface layer of the sintered material is unlikely to crack even if the sintered material is pulled. Such a sintered material of the present disclosure is suitably utilized for materials requiring high tensile strength. Here, the surface layer of the sintered material includes the range up to 200 μm from the surface of the sintered material toward the inside. In addition, the above-described cross-section is taken from the surface layer of the sintered material.

(2) As an example of a sintered material of the present disclosure, a form in which the relative density is 97% or more is cited.

The above-described form is more dense and therefore is more likely to have high tensile strength.

(3) As an example of a sintered material of the present disclosure, a form in which the number of the compound particles per the unit area is 850 or less is cited.

In the above form, the number of compound particles is not too many. Such a form is likely to inhibit the propagation of cracks while appropriately obtaining the strength enhancement effect by inhibiting the coarseness of the crystal grain. Accordingly, the above-described form is more likely to increase tensile strength.

(4) As an example of a sintered material of the present disclosure, a form in which the number of the compound particles having the size of 0.3 μm or more per unit area is n, the number of the compound particles having a size of 20 μm or more per unit area is $n_{20}$, a ratio of the number $n_{20}$ to the number n is $(n_{20}/n)\times100$, and the ratio is 1% or less is cited.

In the above-mentioned form, there are few coarse compound particles of 20 μm or more. The coarse compound particles are likely to become a starting point of cracking, and are likely to propagate cracking. The above-described form contains such coarse compound particles fewer, and thus is likely to increase the tensile strength.

(5) As an example of the sintered material of the present disclosure, the iron-based alloy contains one or more elements selected from the group consisting of C, Ni, Mo, Mn, Cr, B, and Si, the rest is composed of Fe and impurities.

An iron-based alloy containing the elements listed above, such as steel that is an iron base alloy containing C, has excellent strength such as tensile strength. The above form composed of a high strength iron-based alloy is likely to increase the tensile strength.

(6) A method of manufacturing a sintered material according to one embodiment of the present disclosure includes steps of:

preparing a raw material powder containing an iron-based powder;

producing a powder compact having a relative density of 93% or more using the raw material powder; and sintering the powder compact, wherein the iron-based powder contains at least one of a powder made of pure iron and a powder of iron-based alloy, wherein the step of preparing raw material powder includes a step of reducing the iron-based powder, and wherein the step of reducing the iron-based powder includes a step of heating the iron-based powder up to a range of 800° C. or more and 950° C. or less in a reduced atmosphere.

In the method of manufacturing the sintered material according to the present disclosure, a manufacturing process of producing a powder compact and sintering the powder compact overlaps the basic method of manufacturing the sintered material described in Patent Document 1. In particular, the method of manufacturing a sintered material according to the present disclosure uses an iron-based powder that is heated to the above-described specific temperature and is reduced as a raw material powder. By using this specific reduced powder, a dense powder compact can be formed. In addition, by using the above-described specific reduced powder, it is possible to produce a sintered material in which an appropriate amount of compound particles, such as an oxide, are present. Such a method of manufacturing a sintered material according to the present disclosure can manufacture a sintered material that is a dense sintered material having a relative density of 93% or more, that contains some amount of compound particles having the size of 0.3 μm or more at least in the surface layer of the sintered material, and that contains the aforementioned uniformly dispersed compound particles. In the manufactured sintered material, the coarseness of the crystal grain is inhibited by the dispersed compound particles. The aforementioned sintered material is excellent in strength like having a high tensile strength because the strength is improved by reducing the coarsening of the crystal grain. Accordingly, the method of manufacturing a sintered material according to the present disclosure can produce a sintered material having excellent strength, typically the sintered material according to the present disclosure.

Details of Embodiments of the Present Disclosure

Hereinafter, a sintered material according to an embodiment of the present disclosure and a method of manufacturing a sintered material according to an embodiment of the present disclosure will be described, in turn, with reference to the drawings as appropriate.

[Sintered Material]

A sintered material 1 according to an embodiment will be described with reference to FIG. 1.

FIG. 1A illustrates an external gear wheel as an example of the sintered material 1 in an embodiment. FIG. 1A shows a cross section of part of cut teeth 3 of the plurality of teeth 3.

Figure 1B:
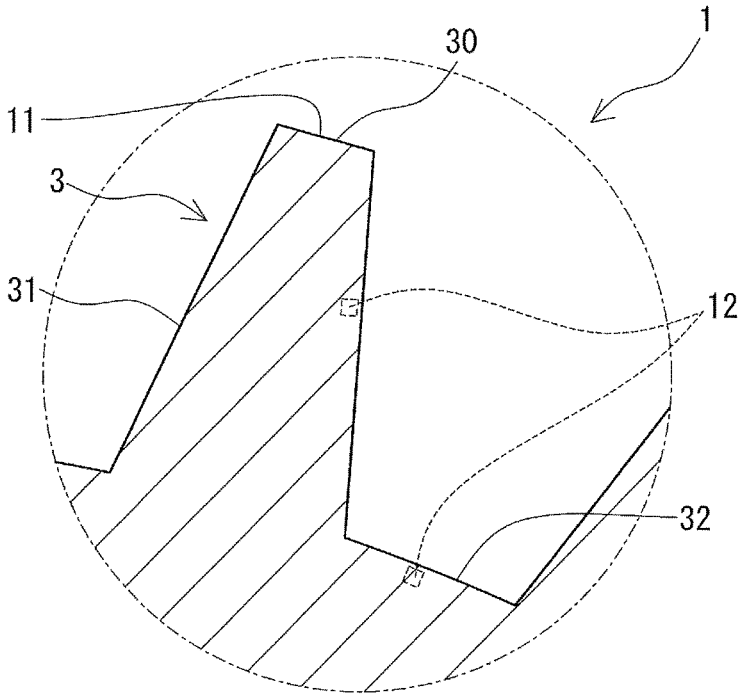
FIG. 1B is a cross-sectional view of an enlarged circle 1B shown in FIG. 1A.

FIG. 1B is an enlarged cross-sectional view showing an inside of a dotted line circle 1B in FIG. 1A.

(Outline)

The sintered material 1 according to the embodiment is a dense sintered material composed of an iron-based alloy mainly composed of Fe (iron), and contains a proper quantity of compound particles 2 (FIG. 2) having a size of 0.3 μm or more. Specifically, the sintered material 1 according to the embodiment comprises a composition composed of an iron-based alloy and the following texture, and has a relative density of 93% or more.

The above-mentioned texture contains 200 or more and 1350 or less compound particles 2 having a size of 0.3 μm or greater per unit area in a cross section of the sintered material 1. The unit area is 100 μm×100 μm. Hereinafter, the "number of compound particles having a size of 0.3 μm or more per unit area of 100 μm×100 μm in a cross section" may be referred to as the "density of the number." More detailed description is described below.

(Composition)

An iron-based alloy is an alloy containing an additive element and the rest of which is composed of Fe and impurities. The additive elements include, for example, one or more elements selected from the group consisting of C (carbon), Ni (nickel), Mo (molybdenum), Mn (manganese), Cr (chromium), B (boron), and Si (silicon). In addition to Fe, iron-based alloys containing the elements listed above have superior strength. The sintered material 1, which is composed of an iron-based alloy with excellent strength, is excellent in strength, like having high tensile strength.

The content of each element listed above is listed as follows when an iron-based alloy is made 100% by mass. The higher the content of each element, the greater the strength of the iron-based alloy. The sintered material 1, which is composed of a high-strength iron-based alloy, is likely to have a high tensile strength.

<C>0.1% or more by mass and 2.0% or less by mass

<Ni>0.0% or more by mass and 5.0% or less by mass

<Total amount of Mo, Mn, Cr, B, Si>0.1% or more by mass and 5.0% or less by mass Hereinafter, Mo, Mn, Cr, B, and Si are collectively referred to as "elements such as Mo."

An iron-based alloy containing C, typically carbon steel, has superior strength. When the content of C is 0.1% or more by mass, it is expected to improve the strength and hardenability. When the content of C is 2.0% or less by mass, it is possible to prevent a decrease in ductility and toughness while having a high strength. The content of C may be 0.1% or more by mass and 1.5% or less by mass, 0.1% or more by mass and 1.0% or less by mass, and 0.1% or more by mass and 0.8% or less by mass.

Containing nickel improves toughness as well as strength. The higher the nickel content, the higher the strength, and the higher the toughness. When the content of nickel is 5.0% or less by mass, the amount of residual austenite in the sintered material after sintering easily decreases when quenching and tempering are performed after sintering. Therefore, softening caused by the formation of a large amount of residual austenite can be prevented. Accordingly, the hardness of the sintered material 1 after quenching and tempering is easily increased by using the tempered martensite phase as the main texture. The nickel content may be 0.1% or more by mass and 4.0% or less by mass, and 0.25% or more by mass and 3.0% or less by mass.

If the total content of elements such as Mo is 0.1% or more by mass, further improvement of the strength is expected. When the total content of elements such as Mo is 5.0% or less by mass, it is possible to prevent the decrease in toughness and brittleness while maintaining a high strength. The total content of elements such as Mo may be not less than 0.2% by mass and not more than 4.5% by mass, and further not less than 0.4% by mass and not more than 4.0% by mass. The content of each element may be, for example, cited below.

<Mo>0.0% or more by mass and 2.0% or less by mass, and 0.1% or more by mass and 1.5% or less by mass <Mn>0.0% or more by mass and 2.0% or less by mass, and 0.1% or more by mass and 1.5% or less by mass <Cr>0.0% or more by mass and 4.0% or less by mass, and further 0.1% or more by mass and 3.0% or less by mass <3>0.0% or more by mass and 0.1% or less by mass, and further 0.001% or more by mass and 0.003% or less by mass <Si>0.0% or more by mass and 1.0% or less by mass, and further 0.1% or more by mass and 0.5% or less by mass Among elements such as Mn, an iron-based alloy is superior in strength, particularly when the iron-based alloy contains Mo and Mn. Mn contributes to the improvement in hardenability and strength. Mo contributes to an increase in high-temperature strength and a decrease in temper embrittlement. Preferably, Mo and Mn are contained in the above ranges, respectively.

For example, to measure the overall composition of sintered material 1, an energy dispersive X-ray spectrometry EDX or EDS, an inductively coupled plasma emission spectroscopy (ICP-O ES) and the like may be used.

(Texture)

<Compound Particle>

Figure 2:
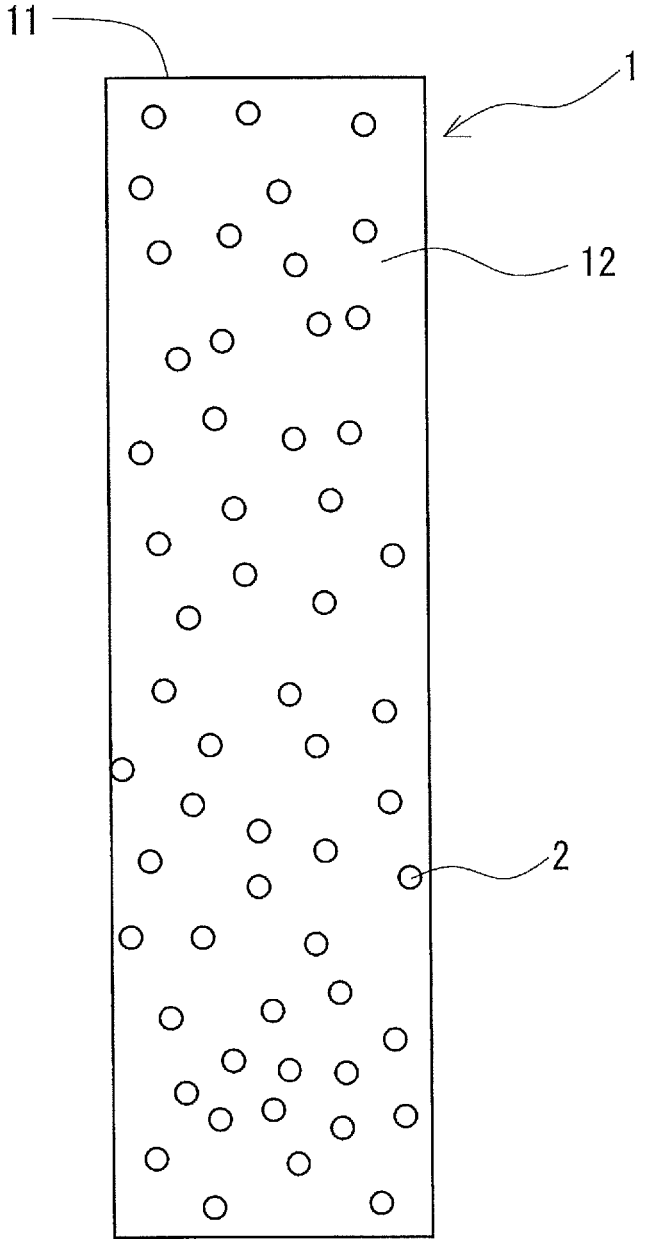
FIG. 2 is a schematic cross-sectional view showing an enlarged cross-sectional structure of a sintered material according to an embodiment.

The sintered material 1 of the embodiment includes compound particles 2 (FIG. 2). Compounds constituting the compound particles 2 herein include an oxide, a sulfide, a carbide, a nitride and the like containing the constituent elements of the sintered material 1 (see the composition section above) and at least one element of the impurity element. The above-described impurity elements include unavoidable impurities and elements added as deoxidizing agents. The compound particles 2 are inevitably formed in the manufacturing process.

<<Number>>

The sintered material 1 according to the embodiment includes some degree of compound particles 2 having a size of 0.3 μm or more at least in the surface layer of the sintered material 1 in a cross section. Quantitatively, in a cross section of the sintered material 1, when a square region having a side of 100 μm is made a region having a unit area, the number of compound particles 2 of 0.3 μm or more present in the unit area (density of the number) is 200 or more and 1450 or less. If the density of the number is 200 or more, it can be said that there is a certain amount of compound particles 2. Because these compound particles 2 are uniformly dispersed as shown in FIG. 2, the coarseness of the crystal grains of the sintered material 1 is inhibited. As a result, the sintered material 1 is unlikely to break even if pulled, and has a high tensile strength. If the density of the number of particles is 1350 or less, it can be said that there is no excessive compound particles 2. In the sintered material 1, while the strength improvement effect is obtained by inhibiting the above-described crystal grain enlargement, it is possible to inhibit the compound particles 2 from becoming the crack starting point or propagating the crack. Accordingly, the sintered material 1 according to the embodiment has is excellent in strength, like having a high tensile strength.

The larger the density of the above-described number, the easier it is to obtain the strength improvement effect by inhibiting the coarseness of the crystal grain, and the sintered material 1 is likely to have a high tensile strength. Therefore, it is preferable that the density of the above number be not less than 250, further not less than 300, and not less than 350. The smaller the density of the above-described number, the more likely it is to inhibit the generation and propagation of cracks caused by the compound particles 2, and the sintered material 1 has a high tensile strength. Therefore, it is preferable that the density of the above number be not more than 1300, further not more than 1250, not more than 1200, not more than 1000, and not more than 900. In particular, it is more preferable that the density of the above number be 850 or less. This is because the sintered material 1 is likely to have a higher tensile strength by inhibiting the propagation of cracks by the compound particles 2 while appropriately obtaining the strength improvement effect by inhibiting the coarseness of the crystal grains.

A method of adjusting the present state of compound particles 2 (the density of the above-described number) is, for example, to adjust the amount of oxide formed in an iron-based powder used as a raw material by a reduction treatment in the manufacturing process as described below. The higher the heating temperature in the reduction treatment, the lower the presence of the compound particles 2. If the heating temperature is somewhat low, the compound particles 2 can be formed to some extent.

<<Method of Measuring Density of Compound Particles>>

In the cross section of the sintered material 1, the density of the above-described number is measured as follows, for example. A more specific measurement method is described in Test Example 1 below.

(1) A cross-section of the sintered material 1 is taken. As shown in FIG. 1B, a surface 11 of the sintered material 1 and its proximity area (surface layer) are preferably formed in the cross section of the sintered material 1. When the sintered material 1 is pulled, cracking is likely to occur from the surface layer of the sintered material 1. In addition, when the sintered material 1 includes a carburized curing layer on the surface layer of the sintered material 1, the surface layer of the sintered material 1 is harder than the inside of the sintered material 1. Therefore, cracking is likely to occur further from the surface layer of the sintered material 1. Hereinafter, the case where the measurement point of the compound particle 2 is the surface layer will be described.

A cross section of the sintered material 1 can be viewed from a surface 11 of the sintered material 1 toward the interior in a region up to 200 μm. For example, if the sintered material 1 is an annular gear shown in FIG. 1A, the surface 11 includes a surface of a tooth tip 30 in the tooth 3, a surface of a tooth surface 31, a surface of a tooth bottom 32, an end surface 40 located at an axial end of the through hole 41, an inner peripheral surface of the through hole 41, and the like. If the sintered material 1 is a cylinder such as the annular gear shown in FIG. 1A, the cross section includes a plane perpendicular to the axial direction of the through hole provided in the cylinder or a plane parallel to the axial direction. More specific cross-sections include a plane perpendicular to the thickness direction of the gear (FIG. 1B) or a plane parallel to the thickness direction of the gear. Alternatively, if the sintered material 1 is an annular gear as shown in FIG. 1A, the cross section may be a curved surface rather than a flat surface. For example, the cross-section may be a curved surface along a cylindrical surface coaxial with the axis of the gear (the axis of the through hole 41) (e.g., the inner circumferential surface of the through hole 41) or a curved surface along a surface parallel to a portion thereof (e.g., the surface of the tooth tip 30, the surface of the tooth bottom 32). If the sintered material 1 is a cuboid, the cross section may be a plane parallel to one surface of the outer peripheral surface of the cuboid.

The top surface of the sintered material 1 and the region near the top surface are preferably removed. This is because impurities and the like may be present in the top surface and the region near the top surface of the sintered material 1, and proper measurement may not be performed. The removal thickness can range from 10 μm to 30 μm. The surface 11 of the sintered material 1 is the surface after removal.

(2) A cross-section of the sintered material 1 is observed with a scanning electron microscope (SEM), and a rectangular region, 50 μm in width and 200 μm in length, is extracted from the surface 11 toward the inside as a measurement region (field of view). The observed magnification should be selected from, for example, 3,000 to 10,000 times. The number of measurement regions shall be one or more.

(3) One extracted measurement region is further divided into two or more microscopic regions. The number of fractions k is, for example, 50 or more and further 80 or more. For each microscopic region, a commercially available automated particle analysis system or commercially available software is used to extract particles that are present in each microscopic region and have a size of 0.3 μm or more. Here, "particles having a size of 0.3 μm or more" means particles having a diameter of 0.3 μm or more. The particle diameter is obtained as follows. The area of the extracted particles (here, the cross-sectional region) is obtained. The diameter of a circle having an area equivalent to that of the particles is obtained. The diameter of the particle is assumed to be the diameter of the circle. The particles may include holes in addition to particles composed of compounds such as oxides as described above. Therefore, by performing component analysis of each particle using SEM-EDS and the like, the compound particles and the holes are distinguished from each other. Only compound particles are extracted from each microscopic region, and the number $n_k$ of the compound particles is measured. By summing the number $n_k$ of each of the microscopic regions, the total number N of the compound particles in a single measurement region is obtained. The number n of the compound particles per 100 μm×100 μm is calculated using the measured total number N and the area S ($\mu m^2$) of the measurement region.

The number n in a single measurement region is calculated by (N×100×100)/S. The above number n is assumed to be the density of the sintered material 1.

<<Size>>

The smaller the size of the compound particle 2 (the diameter described above), the more preferable it is. Because the fine compound particles 2 are dispersed in the sintered material 1, the coarseness of the crystal grain is inhibited, and thus the strength improvement effect is easily obtained. In addition, it is preferable that there are fewer coarse compound particles 2 of 20 μm or more in particular. If the coarse compound particle 2 is small, the coarse compound particle 2 is easily prevented from becoming the crack starting point or propagating the crack. Quantitatively, the following ratio $(n_{20}/n)\times100$ is 1% or less. The above-described n is the number of compound particles 2 having the size of 0.3 μm or more per unit area. The $n_{20}$ is the number of compound particles 2 having the size of 20 μm or more per unit area. The unit area here is 100 μm×100 μm. The ratio $(n_{20}/n)\times100$ is the ratio of the number $n_{20}$ to the number n. If the above ratio is 1% or less, it can be said that the coarse compound particles 2 are sufficiently small. If the above ratio is 1% or less, the size of the compound particle 2, which accounts for more than 99% of the number of particles n, is less than 20 μm. That is, many of the compound particles 2 are small. The smaller the ratio, the fewer the number $n_{20}$. Therefore, the above-described coarse compound particle 2 is unlikely to be the crack starting point. The above ratio is preferably 0.8% or less and 0.7% or less, and ideally 0%. The size of the coarse compound particle 2 is preferably, for example, 150 μm or less, further preferably 100 μm or less, and 50 μm or less.

As the size of the compound particle 2, which accounts for 99% or more of the above-described number of particles n, becomes smaller, it is more expected to improve the strength by reducing the coarseness of the crystal grain. For example, the size of these compound particles 2 is preferably less than 20 μm, further preferably 10 μm or less, 5 μm or less and 3 μm or less. The size of all compound particles 2 per the above-described unit area is preferably 20 μm or less.

<<Texture After Heat Treatment>>

The sintered material 1 according to the embodiment is still sintered. Alternatively, the sintered material 1 according to the embodiment can be one that has been sintered and then subjected to at least one of carburization and quenching/tempering. Especially, the sintered material 1 that is subjected to carburization and quenching/tempering is superior in terms of mechanical characteristics. The sintered material 1 to which carburization is applied includes a carburizing layer (not shown) ranging from the surface 11 to the inside up to about 1 mm. In the sintered material 1 having a carburizing layer, the region near the surface 11 is harder than the inside of the sintered material 1. Therefore, the sintered material 1 including the carburizing layer can improve the wear resistance. The quenched/tempered material 1 has a structure consisting of (tempered) martensites. The sintered material 1 having the (tempered) martensitic structure is hard and excellent in toughness and tenacity, and is easy to enhance. The hardness and toughness of the sintered material 1 are both superior if the material consists substantially of (tempered) martensite and contains no excessive residual austenite. Such sintered material 1 has a high tensile strength.

(Relative Density)

The relative density of the sintered material 1 according to the embodiment is 93% or more. Such a sintered material 1 is dense and has few holes. Therefore, in the sintered material 1, cracks or fractures caused by the holes are unlikely to occur or substantially do not occur. Such sintered material 1 has a high tensile strength. When the relative density is 95% or more and 97% or less, it is preferable that the tensile strength be easily increased. In addition, the relative density may be 98% or more and 99% or more. The above relative density is ideally 100%, but it may be 99.6% or less while considering manufacturability and the like.

The relative density (%) of the sintered material 1 is obtained by taking a plurality of cross sections from the sintered material 1, observing each cross section with a microscope (SEM, light microscope, etc.), and analyzing the observed image. For example, when the sintered material 1 has a columnar body or a cylindrical body, cross sections are taken from a region on each end side of the sintered material 1 and a region near the center of the length along the axial direction of the sintered material 1. The region on the end surface side of the sintered material 1 includes, for example, a region of 3 mm or less from the surface of the sintered material 1 toward the inside, although depending on the length of the sintered material 1. The region near the center of the sintered material 1 includes, for example, a region up to 1 mm from the center of the length toward each end surface (a total region of 2 mm), although depending on the length. The cross sections include axially intersecting planes, typically orthogonal planes described above. Multiple (eg, 10 or more) viewing fields are obtained from each cross section. The size (area) of one viewing field is cited, for example, 500 μm×600 μm=300,000 $\mu m^2$ as an example. When multiple viewing fields are taken from one cross section, it is preferable to divide the cross section equally and obtain viewing fields from each divided region. The observed images of each observation field are processed by image processing (e.g., binarization processing) to extract regions composed of metals from the processed images. The region of the extracted metal is obtained. In addition, the ratio of the area of the metal to the area of the observed field of view is obtained. The ratio of this area is regarded as the relative density of each observation field. The relative densities of the observed fields are averaged. The obtained average value is made a relative density (%) of the sintered material 1.

(Mechanical Properties)

The sintered material 1 according to the embodiment has a high tensile strength of, for example, 1300 MPa or more, although depending on the composition and relative density (see Test Example 1 below).

(Purpose)

The sintered material 1 of the embodiment can be used for a variety of general structural components, such as mechanical components. The mechanical components include various gears, including sprockets, rotors, rings, flanges, pulleys, bearings, and the like. In addition, the sintered material 1 according to the embodiment can be suitably used for an application in which a high tensile strength is required.

(Major Effects)

The sintered material 1 according to the embodiment has a high relative density and is dense, and there is a specific amount of compound particle 2 having a size of 0.3 μm or more. The sintered material 1 according to such an embodiment is excellent in strength, like having a high tensile strength. This effect is specifically described in Test examples below.

[Method of Manufacturing Sintered Material]

The sintered material 1 of the embodiment may be manufactured, for example, by a method of manufacturing the sintered material of the embodiment including the following steps.

(First step) A raw material powder containing an iron-based powder is prepared.

(Second step) A powder compact with a relative density of 93% or more is manufactured using the raw material powder described above.

(Third step) The powder compact is sintered.

The iron-based powder includes a powder composed of pure iron and at least one powder composed of an iron-based alloy.

In the first step, the iron-based powder is subjected to a reduction treatment. In the reduction treatment, the iron-based powder is heated to a temperature between 800° C. or more and 950° C. under a reduction atmosphere.

Hereinafter, each process will be described.

(First Process: Preparation of Raw Material Powder)

<Composition of Powder>

A composition of a raw material powder may be adjusted according to a composition of an iron-based alloy forming a sintered material. The raw material powders include an iron-based powder. The iron-based powder is a powder composed of a composition containing Fe. Examples of the iron-based powder include an alloy powder composed of an iron-based alloy having the same composition as the iron-based alloy that forms the sintered material, an alloy powder composed of an iron-based alloy having a composition different from that of the iron-based alloy that forms the sintered material, or a pure iron powder. The iron-based powder can be manufactured by a water atomization method, a gas atomization method, and the like. Examples of the specific raw material powders are cited in the following.

(a) The raw material powder includes an alloy powder composed of an iron-based alloy with the same composition as the iron-based alloy making up the sintered material.

(b) The raw material powder includes an alloy powder composed of the following iron-based alloy and carbon powder. The iron-based alloy contains one or more elements selected from the group consisting of Ni, Mo, Mn, Cr, B, and Si, with the rest composed of Fe and impurities.

(c) The raw material powder includes a pure iron powder, a powder comprising one or more elements selected from the group consisting of Ni, Mo, Mn, Cr, B, and Si, and a carbon powder.

As described in (a) and (b) above, when the raw material powder contains the alloy powder, it is easy to produce a sintered material that uniformly contains elements such as Ni and Mo. The raw material powder may include an alloy powder described in one of (a) and (b) above and a powder composed of one or more elements listed in (c) above.

The size of the raw material powder can be appropriately selected. For example, the average particle diameter of the alloy powder or the pure iron powder described above is 20 μm or more and 200 μm or less, and further 50 μm or more and 150 μm or less. When the average particle diameter of the main alloy powder and the like satisfies the above range, the raw material powder is easily pressurized. Therefore, it is easy to produce a powder compact with a relative density of 93% or more.

An average particle diameter of a powder composed of elements such as Ni or Mo is, for example, 1 μm or more and 200 μm or less. For example, the average particle diameter of the carbon powder is 1 μm or more and 30 μm or less. In addition, the carbon powder smaller than the alloy powder or the pure iron powder is available.

The average particle size here is defined as the particle size (D50) in which the cumulative volume in the volume particle size distribution measured by a laser diffraction particle size distribution measuring device is 50%.

Alternatively, the raw material powder may contain at least one of a lubricant and an organic binder. If the total content of the lubricant and the organic binder is 0.1% or less by mass, for example, when the raw material powder is assumed to be 100% by mass, it is easy to produce a powder compact. If the raw material powder does not contain a lubricant and an organic binder, it is easier to produce a powder compact and there is no need to degrease the powder compact in a later process. In this regard, the omission of the lubricant contributes to the improvement of the mass productivity of the sintered material 1.

<Reduction Treatment>

The iron-based powder described above is subjected to a reduction treatment. The reduction treatment reduces the oxide film that may be present on the surface of each iron-based powder and oxygen that adheres to the surface. Therefore, the oxygen concentration in the iron-based powder is reduced. By adjusting the conditions of the reduction treatment, the oxygen concentration can be within an appropriate range. By using a raw material powder containing an iron-based powder in which the oxygen concentration is adjusted appropriately, a powder compact with a specified range of oxygen concentration can be manufactured. By sintering the powder compact, the amount of oxide produced can be controlled by combining the oxygen contained in the powder compact with the elements contained in the powder compact. As a result, the sintered material 1 containing the compound particles 2 made of an oxide can be manufactured. Many of the compound particles 2 are mainly made of an oxide. Accordingly, by controlling the amount of oxide, the content of the compound particles 2 can be controlled to a specific range.

The reduction treatment is performed by heating the iron-based powder under a reducing atmosphere. If the heating temperature is 800° C. or more, it is possible to appropriately reduce oxygen from the iron-based powder. For example, the oxygen concentration of the iron-based powder may be reduced to 2400 ppm or less, further to 2200 ppm or less, or to 2000 ppm or less. If the heating temperature is less than 950° C., oxygen in the iron-based powder is likely to remain to some extent. The residual oxygen allows the formation of an oxide when sintering. Therefore, the sintered material 1 containing the compound particles 2 within the above-described specific range can be manufactured. For example, the oxygen concentration of the iron-based powder may be greater than 800 ppm by volume, further greater than 850 ppm, or greater than 900 ppm. Preferably, the heating temperature is 820° C. or more and 945° C. or less, and further, 830° C. or more and 940° C. or less. In this temperature range, the sintering material 1 having a high tensile strength can be easily manufactured because it is difficult to generate cracks or to propagate cracks by the compound particles 2 while appropriately obtaining the strength improvement effect by inhibiting the coarseness of the crystal grains of the compound particles 2.

The aforementioned heating temperature retention period in the reduction treatment can be selected from, for example, a range of 0.1 hours or more and 10 hours or less, and a range of 0.5 hours or more and 5 hours or less. When the above-described heating temperature is the same, the longer the retention period, the more likely the oxygen concentration of the iron-based powder is likely to decrease. The shorter the retention period, the shorter the processing period and the shorter the sintered material manufacturing period. Therefore, the manufacturability of the sintered material can be improved. Heating is stopped after the above retention period has elapsed.

The reduction atmospheres include, for example, an atmosphere containing a reducing gas and a vacuum atmosphere. The reducing gases include hydrogen gas, carbon monoxide gas and the like. The atmospheric pressure of the vacuum atmosphere may be, for example, 10 Pa or less.

(Second Process: Molding)

In this process, by compressing the raw material powder containing the reduced iron-based powder described above, a powder compact with a relative density of 93% or more is formed. In the method of manufacturing a sintered material according to the embodiment, by using the powder compact with the relative density of 93% or more, a sintered material with the relative density of 93% or more can be manufactured. Typically, this is because the sintered material substantially maintains the relative density of the powder compact. As the relative density of the powder compact becomes higher, the sintered material having the higher relative density can be manufactured. Therefore, the relative density of the powder compact may be 95% or more, further 97% or more, and 98% or more. The relative density of the powder compact may be 99.6% or less while considering the manufacturability and the like as described above.

The relative density of the powder compact may be obtained in the same manner as that of the sintered material 1 described above. In particular, when the powder compact is molded by uniaxial pressure, the cross section of the powder compact may be taken from the region near the center of the length along the pressurizing axis direction in the powder compact, and from the region on the end-face side located at both ends in the pressurizing axis direction. Cross-sections include a plane that intersect in the pressurizing axis direction, typically a plane orthogonally intersect in the pressurizing axis direction.

The powder compact can be manufactured using a press device that typically has a die capable of uniaxial pressurization. The die typically includes a die having a through-hole and an upper and lower punch that fits into the upper and lower openings of the through-hole, respectively. The inner periphery of the die and the end face of the lower punch form a cavity. The raw material powder is filled into the cavity. The powder compact can be made by compressing the raw material powder in the cavity with an upper punch and a lower punch at a predetermined molding pressure (face pressure).

The shape of the powder compact may be along the final shape of the sintered material or may be different from the final shape of the sintered material. The powder compact, which has a shape different from the final shape of the sintered material, may be cut and processed in the post-molding process. As for processing after molding, as will be described later, if it is performed on a pre-sintered powder compact, it can be performed efficiently, which is preferable. In this case, for example, if the shape of the powder compact is a simple shape such as a column or a cylinder, it is easy to form the powder compact with high precision, and the workability of the powder compact is excellent.

Lubricant can be applied to the inner peripheral surface of the mold described above. In this case, the powder compact is easily formed while preventing the raw powder from burning onto the mold. The lubricants include, for example, a higher fatty acid, a metal stone, a fatty acid amide, a higher fatty acid amide, and the like.

The higher the molding pressure, the higher the relative density of the powder compact and the more densely the powder compact can be produced. As a result, a fine sintered material can be produced. The molding pressure may be, for example, 1560 MPa or more. Further, the molding pressure may be 1660 MPa or more, 1760 MPa or more, 1860 MPa or more, and 1960 MPa or more.

(Third Process: Sintering)

<Sintering Temperature and Sintering Period>

In this process, the powder compact is sintered to produce a sintered material having a relative density of 93% or more. The sintering temperature and sintering period may be selected depending on the composition of the raw material powder. The sintering temperature may be, for example, 1100° C. or more and 1400° C. or less. The sintering temperature may be 1110° C. or more and 1300° C. or less, 1120° C. and more and 1250° C. or less. The method of manufacturing the sintered material of the embodiment uses a dense powder compact having a high density as described above. Therefore, a relatively low-temperature sintering at less than 1250° C. can produce a fine sintering material as described above without firing by high-temperature sintering at 1250° C. or more. For example, the sintering period of time may be from 10 minutes to 150 minutes or less.

<Atmosphere>

Examples of the sintering atmosphere include a nitrogen atmosphere and a vacuum atmosphere. In the nitrogen atmosphere or the vacuum atmospheres, the oxygen concentration in the atmosphere is low (e.g., less than 1 ppm by volume), and the formation of oxides can be reduced.

The atmospheric pressure in a vacuum atmosphere may be, for example, 10 Pa or less.

(Other Processes)

Alternatively, the method of manufacturing the sintered material according to an embodiment may comprise at least one of the following first processing step, the heat treatment step, and the second processing step.

<First Processing Step>

In this process, after the second process (molding process) described above, and before the third process (sintering process), the powder compact is machined. The machining may be rolling or turning. Specific processes include tooth cutting and drilling. The pre-sintered powder compact has superior machinability compared to the sintered material and the melted material. In this regard, cutting before the sintering process contributes to the improvement in mass productivity of the sintered material.

<Heat Treatment Process>

Heat treatments of this process include carburizing and quenching/tempering. Alternatively, the heat treatment of the process may be by carburizing.

Carburizing conditions include, for example, a carbon potential (C.P.) of 0.6% to 1.8% by mass, a treatment temperature of 910° C. to 950° C., and a treatment period of time of 60 minutes to 560 minutes or less. However, the optimum carburizing time generally depends on the product size of the sintered material. Therefore, the above period of time is only an example.

Examples of quenching conditions are an austenitization processing temperature of 800° C. to 1000° C., a processing period of 10 minutes to 150 minutes, and then quenching with oil or water cooling.

The tempering conditions include a treatment temperature of 150° C. to 230° C. and a treatment period of 60 minutes to 240 minutes or less.

<Second Processing Step>

This process involves finishing the sintered material after sintering. Finishing includes, for example, polishing and the like. Finishing enables the production of the sintered material with excellent surface properties and design dimensions by reducing surface roughness of the sintered material.

(Major Effects)

The method of manufacturing the sintered material according to the embodiment can manufacture a relatively dense and fine sintered material including a specific amount of compound particles having a size of 0.3 μm or more, typically the sintered material 1 according to the above-described embodiment. Accordingly, the method of manufacturing the sintered material according to the embodiment can manufacture a sintered material 1 excellent in strength, like having the high tensile strength.

Test Example 1

Iron-based powders with different oxygen concentrations were used as the raw material powders to produce sintered materials with different relative densities, and the structure and tensile strength of the sintered material were examined.

The sintered material was produced as follows. A raw material powder is used to make the powder compact. The obtained powder compact is sintered. After sintering, carburizing and quenching were performed in this order.

As the raw material powder, a mixed powder containing the following alloy powder composed of an iron-based alloy and a carbon powder is used.

The iron-based alloy contains 2% by mass of Ni, 0.5% by mass of Mo, and 0.2% by mass of Mn, with the rest composed of Fe and impurities.

The carbon powder content is 0.3% by mass with the total mass of the mixed powder of 100% by mass.

The average particle size (D50) of the alloy powder is 100 μm. The average particle size (D50) of the carbon powder is 5 μm.

An alloy powder having a different oxygen concentration was prepared by performing a reduction treatment on the above prepared alloy powder. Here, seven types of alloy powders with different oxygen concentrations were prepared by varying at least one of the heating temperature and the retention period in the reduction treatment. The heating temperature is selected from the range of 800° C. to 1000° C. The above retention period is from 1 hour or more and 5 hours or less. The atmosphere during the reduction treatment is made a hydrogen atmosphere.

After the reduction treatment, the oxygen concentration (mass ppm) of the alloy powder of each sample was measured, and the results are shown in Table 1. Here, the oxygen concentration is measured using an inert gas fusion infrared absorption method. Specifically, an alloy powder of each sample is melted by being heated in an inert gas, and oxygen is extracted. The amount of extracted oxygen is measured. The oxygen concentration (mass ppm) is a mass ratio of oxygen to the alloy powder that is assumed to be 100% by mass.

For a sample in which the oxygen concentration of the alloy powder is 1210 ppm or less by mass, the above heating temperature is any of 900° C., 930° C., 945° C., and 1000° C. The higher the heating temperature, the lower the oxygen concentration of the alloy powder. Here, the heating temperature of the sample with an oxygen concentration of 400 ppm by mass is 1000° C. The retention periods of these samples are the same.

In the sample in which the oxygen concentration of the alloy powder is 1600 ppm or more by mass, the above-mentioned heating temperature is 800° C., and the oxygen concentration differs due to the different retention periods. The longer the retention period, the lower the oxygen concentration of the alloy powder. Here, the retention period of a sample with an oxygen concentration of 1620 ppm by mass is the shortest of these samples.

A reduced iron-based powder (alloy powder described above) is combined with carbon powder. Here, the powder described above is mixed for 90 minutes using a V-shaped mixer. The powder after mixing is used as a raw material powder. The raw material powder was pressurized to form a columnar powder compact. The powder compact dimensions are 075 mm in diameter and 20 mm in thickness.

The powder compact was prepared by selecting the powder compact pressure from a range of 1560 MPa to 1960 MPa so that the relative density (%) of the powder compact became any of 91%, 93%, 95%, and 97% for each sample. The higher the molding pressure, the easier it is to obtain a powder compact with a higher relative density. Table 1 shows the relative density (%) of the powder compact of each sample.

The prepared powder compact was sintered under the following conditions. After sintering, carburizing was performed under the following conditions, and then tempering was performed to obtain the sintered material of each sample.

(Sintering Conditions) Sintering temperature: 1130° C., retention period: 30 minutes, atmosphere: nitrogen (Carburizing) 930° C.×90 minutes, carbon potential: 1.2% by mass→850° C.×30 minutes→oil cooling (Tempering) 200° C.×90 minutes As described above, a columnar sintered material having a diameter of 075 mm and a thickness of 20 mm was obtained. The sintered material is a composition of an iron-based alloy containing 2% by mass of nickel, 0.5% by mass of Mo, 0.2% by mass of Mn and 0.3% by mass of C, and the rest composed of Fe and impurities. For each prepared sintered material, the density (number/(100 μm×100 μm)), the tensile strength (MPa), and the relative density (%) were measured. Here, the density of the number is the number of compound particles having the size of 0.3 μm or more per unit area in the cross section of the sintered material. The unit area is 100 μm×100 μm.

(Texture Observation)

For each sintered material cross-section, SEM automated particle analysis was performed to determine the density of the number described above. Here, the number of compound particles was investigated in the surface of the sintered material and the neighboring area (surface layer) of the sintered material as the measurement target in the cross section of the sintered material. A commercially available automated particle analysis system (JSM-7600F, SEM manufactured by Nippon Electronics Co., Ltd.) was used. The utilized particle analysis software is *INCA* (manufactured by Oxford Instruments). The specific measurement procedure will be described below.

A rectangular specimen containing the top surface is cut from the sintered material of each sample. The specimen dimensions are 4 mm×2 mm×3 mm high. The specimen is cut from the sintered material so that it has an area of 4 mm×2 mm on the top surface and a height of 3 mm. A region up to 25 μm from the highest surface of the cut rectangular specimen is removed. The surface after removal is made a surface of the specimen. The 4 mm×3 mm surface of the specimen is planarized by cross-sectional polisher processing (CP processing) with Ar (argon) ions. This CP machining surface is used as the measurement surface.

For the above-described measurement surface, for the region up to 200 μm from the surface of the specimen, i.e., along the height direction, a region 50 μm in width is defined as the measurement region. That is, the measurement region is a rectangular region with a width of 50 μm and a length of 200 μm. Here, one measurement region is taken from one specimen. FIG. 2 is a schematic diagram of a measurement region 12 of the sintered material 1 of sample No. 5. In FIG. 2, circles schematically show compound particles 2. The region where the compound particles 2 are present is an iron-based alloy that constitutes the parent phase of the sintered material 1. Compound particles 2 are typically dispersed uniformly in the parent phase constituted of the iron base alloy, as shown in FIG. 2. FIG. 2 omits hatching.

The extracted measurement region is further divided into two or more microscopic regions to extract particles present in each microscopic region. Here, the above-mentioned measurement region is divided into 82 (number of divisions k=82). The SEM magnification is 10,000 times. Particle extraction is performed based on contrast differences in SEM observations. Here, the reflected electron image is used as the SEM observation image. Conditions for binary processing are set based on the threshold contrast intensity in the reflected electron image. Then, for the binary processing image, particles are extracted based on the contrast differences. In addition, a hole filling process and an opening process are performed for the binary processing image to cut the image of adjacent particles. The area of each extracted particle is obtained. The diameter of the circle having the same area as the obtained area is obtained. The particles having a diameter of 0.3 μm or more of the circle are extracted. Component analysis is performed by SEM-EDS for the extracted particles greater than 0.3 μm, respectively. The results of component analysis are used to distinguish between particles made of an oxide and the like and holes, and only particles made of a compound such as an oxide and the like are extracted. The period for component analysis here is 10 seconds.

The number of particles $n_k$ consisting of the oxide and the like for each micro region is measured. The number $n_k$ in the k microscopic regions are summed up. This sum (summation) is the total number N of particles composed of oxide and the like in one measurement region. Using the total number N and the area S of one measurement region (here, 50 μm×200 μm), the number n per 100 μm×100 μm is given by n=(N×100×100)/S. The number n of the measurement region in each sample is assumed to be the density of the number in each sample, and is shown in Table 1.

(Tensile Strength)

Tensile strength was measured using a general-purpose tensile tester. Specimens for tensile tests are in accordance with the standards of the Japan Powder Metallurgy Industry Association JPMA M 04-1992, which is a sintering metallic material tensile specimen. The specimen is a plate material cut from the columnar sintered material described above. The specimen is composed of a narrow width section and a wide width sections provided on both ends of the narrow width section. The narrow width section is composed of a central section and a shoulder section. The shoulder section includes an arc-like lateral surface formed from the central section to the wide width section.

The size of the specimen is shown below. A gauge length is 30 mm.

Thickness: 5 mm

Length: 72 mm

Length of center section: 32 mm

Width of the central section in narrow width section: 5.7 mm

Width near narrow width section in shoulder section: 5.96 mm,

Radius R of lateral surface of shoulder section: 25 mm

Width of wide width section: 8.7 mm (Relative Density)

The relative density (%) of the sintered material is obtained by image analysis of the observation of the microscope at the cross-section of the sintered material as described above. Here, in the sintered material of each sample, a cross-section is taken from the region on the end face side and the region near the center of the length along the axial direction of the through-hole provided on the sintered material. The region on the end face side is set within 3 mm of the annular end face of the sintered material. The region near the center is the remaining region from each end face of the sintered material, excluding the region on the end face side, which is 3 mm thick as above, that is, the region of 2 mm in length. A cross section is taken by cutting each region along a plane perpendicular to the axial direction described above. Multiple (10 or more) viewing fields are taken from each cross section. The area of the viewing field is: 500 μm×600 μm=300,000 $\mu m^2$. Image processing is performed on the observed images of each observation field, and regions made of metal are extracted. The area of the extracted metal is obtained. The ratio of the area of the metal to the area of the observed field is obtained. This ratio is regarded as the relative density. The relative densities of observed fields totaling 30 or more are obtained, and further the mean value is obtained. The obtained average value is made the relative density (%) of the sintered material. The relative density (%) of the sintered material 1 is shown in Table 1.

TABLE 1

| SAMPLE No. | RAW MATERIAL POWDER ALLOY POWDER OXYGEN CONCENTRATION MASS ppm | SINTERED MATERIAL RELATIVE CONCENTRATION % | DENSITY OF COMPOUND PARTICLE NUMBER NUMBER/ (100 × 100) $\mu m^2$ | TENSILE STRENGTH MPa |
|---|---|---|---|---|
| 101 | 400 | 91 | 51 | 998 |
| 102 | 804 | | 201 | 996 |
| 103 | 1000 | | 305 | 992 |
| 104 | 1210 | | 402 | 988 |
| 105 | 1620 | | 801 | 985 |
| 106 | 1800 | | 1012 | 980 |
| 107 | 2000 | | 1299 | 979 |
| 108 | 2410 | | 2011 | 979 |
| 109 | 3020 | | 2405 | 971 |
| 111 | 400 | 93 | 50 | 1058 |
| 1 | 804 | | 200 | 1393 |
| 2 | 1000 | | 304 | 1482 |
| 3 | 1210 | | 407 | 1522 |
| 4 | 1620 | | 811 | 1433 |
| 5 | 1800 | | 1024 | 1356 |
| 6 | 2000 | | 1300 | 1311 |
| 114 | 2410 | | 2005 | 1116 |
| 115 | 3020 | | 2411 | 1103 |
| 112 | 400 | 95 | 45 | 1208 |
| 7 | 804 | | 202 | 1583 |
| 8 | 1000 | | 306 | 1678 |
| 9 | 1210 | | 401 | 1709 |
| 10 | 1620 | | 811 | 1631 |
| 11 | 1800 | | 997 | 1600 |
| 12 | 2000 | | 1299 | 1552 |
| 116 | 2410 | | 2001 | 1189 |
| 117 | 3020 | | 2378 | 1173 |
| 113 | 400 | 97 | 50 | 1294 |
| 13 | 804 | | 200 | 1850 |
| 14 | 1000 | | 301 | 1954 |
| 15 | 1210 | | 411 | 1999 |
| 16 | 1620 | | 795 | 1772 |
| 17 | 1800 | | 1023 | 1706 |
| 18 | 2000 | | 1311 | 1576 |
| 118 | 2410 | | 2000 | 1299 |
| 119 | 3020 | | 2401 | 1281 |

As shown in Table 1, the higher the relative density of the sintered material, the higher the tensile strength tends to be. Specifically, the sintered materials of the samples No. 1 to No. 18 and No. 111 to No. 119 with a relative density of 93% or more have a tensile strength higher than that of the samples No. 101 to No. 109 with a relative density less than 93%. When considering the samples No. 1 to No. 18, if the relative density is 93% or more, the tensile strength is 1300 MPa or more, and some samples are 1400 MPa or more. If the relative density is 95% or more, the tensile strength is 1500 MPa or more, and many samples are 1600 MPa or more. If the relative density is 97% or more, the tensile strength is 1570 MPa or more, and many samples are 1700 MPa or more. As one of the reasons why this result was obtained, it is probable that the higher the relative density described above, the smaller the holes, and thus the occurrence of cracks caused by the holes could be reduced.

Next, with respect to the tensile strengths of the dense samples No. 1 to No. 18 and No. 111 to No. 119, when the samples with the same relative densities are compared with each other, they differ from each other. Any sintered material of samples No. 1 to samples No. 18 (hereafter referred to as specific sample group) has higher tensile strength than that of samples No. 111 to No. 119. Quantitatively, any of the tensile strengths of a particular sample group is 1300 MPa or greater.

One of the reasons for the high tensile strength of a specific sample group as described above is the large number of compound particles (the density of the number of particles) of which the size is not less than 0.3 μm per unit area at the cross section of the sintered material. The density of the number in a particular sample group is 200 or more and 1350 or less. Some compound particles are present in a particular sample group. In such a specific sample group, it is considered that the strength improvement effect was appropriately obtained by suppressing the coarseness of the crystal grains (in this case, the old austenite grains) by uniformly dispersing the appropriate amount of compound particles. In addition, appropriate amounts of compound particles are unlikely to be the starting point of cracking or to propagate cracking. As a result, it is thought that the specified sample groups were not likely to break even when pulled. Furthermore, the compound particles have been found to be present at the fracture surface of the broken sample. Based on this, it is considered that the excess compound particles present in the dense sintered material are likely to cause the starting point of crack and the propagation of crack.

In addition, in a particular sample group, it is confirmed that there are few coarse compound particles and many compound particles are minute. Specifically, in the specified sample group, the ratio $(n_{20}/n)\times100$ is 1% or less. The above n is the number of compound particles having 0.3 μm or more and present per unit area as described above. The above $n_{20}$ is the number of compound particles of 20 μm or more present per the unit area. From this, it is considered that the specified sample groups easily obtained the strength improvement effect by inhibiting the coarsening of the crystal grains by the compound particles, and also easily inhibited the generation and propagation of cracks by the compound particles.

In contrast, in samples of No. 111 to No. 113, the density of the above-mentioned number is less than 200, and in this case, the density is not more than about 50. These samples are considered to have a low tensile strength because the above-described compound particles are too scarce, and the strength improvement effect is not sufficiently obtained by inhibiting the coarse grain size. In samples of No. 114 to No. 119, the density of the above number is more than 1350, and is 2000 or more here. These samples are considered to have a low tensile strength due to the tendency of cracking propagated by the compound particles due to the excessive compound particles described above.

One of the reasons for the difference in the presence of compound particles (the density of the number) between the specified sample groups and the samples No. 111 to No. 119 may be caused by the difference in the oxygen concentration of the raw material powder. Here, the oxygen concentration of the alloy powder used in the specified sample group is more than 800 ppm by mass and not more than 2400 ppm by mass, and not more than 2000 ppm by mass. The oxygen concentration of the alloy powder in the specified sample group is higher than the oxygen concentration of the alloy powder used in samples of No. 111 to No. 113 (here 400 ppm by mass). In addition, the oxygen concentration of alloy powder in the specified sample group is lower than the oxygen concentration (in this case greater than 2400 parts per million) of samples of No. 114 to No. 119. The specified sample group is considered to form an appropriate oxide by combining an element contained in a powder compact in sintering oxygen because a powder containing oxygen that is not too high and not too low and in an appropriate range is used as an alloy powder that is main of a raw material powder. As a result, the specific sample group contained particles composed of oxide to a certain extent, and these particles were uniformly dispersed, and it is believed that the coarseness of the crystal grains was inhibited. For samples No. 111 to No. 119, as a result of using a powder with a too low oxygen concentration or a powder with a too high an oxygen concentration, the coarseness of the crystal grains could not be sufficiently suppressed due to the too low particle composed of an oxide or a particle composed of an oxide. It is considered that the above particles were used as the crack starting point or propagation of the crack.

In addition, this study shows the following matter.

Figure 3:
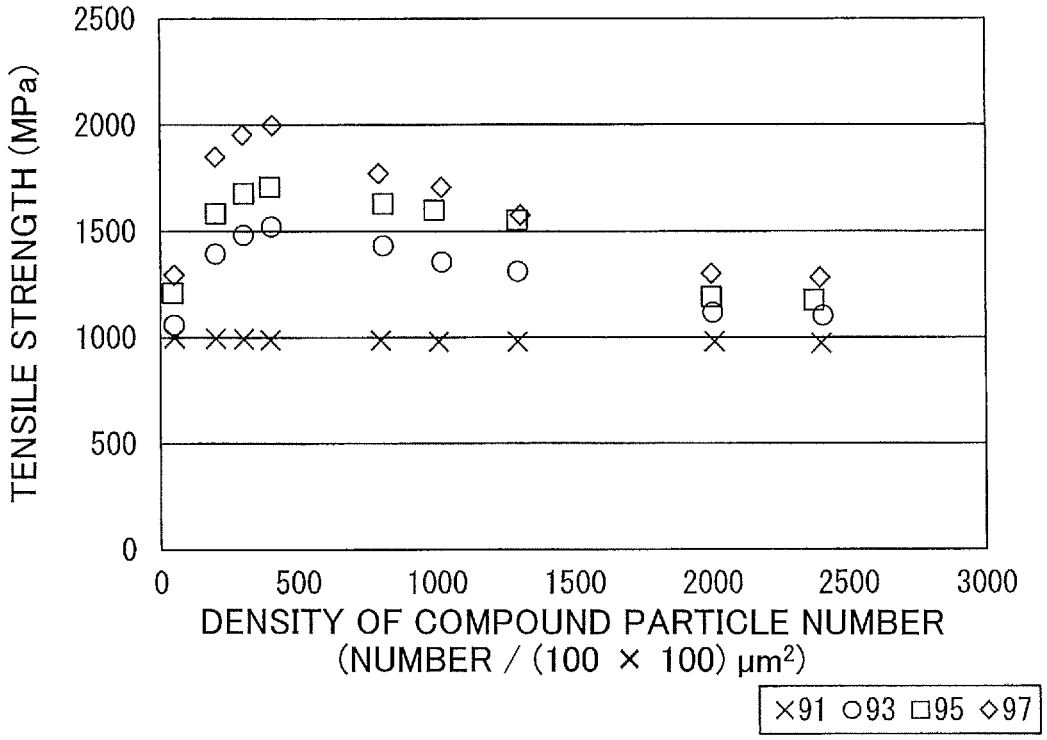
FIG. 3 is a graph showing a relationship between a number of compound particles having a size of 0.3 μm or more per unit area and tensile strength in a sintered material of each sample produced in Test Example 1.

(1) The higher the relative density, the greater the impact of compound particles on tensile strength. This point will be described with reference to FIG. 3. FIG. 3 is a graph showing the relationship between the density of the above-mentioned number (number/(100 μm×100 μm)) and the tensile strength (MPa) for each sintered material of the sample. The horizontal axis of the graph above shows the density of the number (number/(100 μm×100 μm)) in each sample. The vertical axis of the graph above shows the tensile strength (MPa) of each sample. In the graph above, explanatory notes 91, 93, 95, 97 mean the relative density of each sample.

As shown in FIG. 3, when the relative density is 91%, it can be seen that the change in tensile strength is small even when the density of the above-described number is increased or decreased. When the relative density is less than 93%, it can be said that the tensile strength of the sintered material does not substantially depend on the number of compound particles having the size of 0.3 μm or more.

In contrast, when the relative density is 93% or more, attention is given to a range in which the density of the above number is less than about 50, and a range in which the density of the above number exceeds about 1500. In these ranges, even if the number of compound particles larger than 0.3 μm is a few or many, the tensile strength of the sintered material is higher than that of the case where the relative density is 91%. However, in these ranges, the change in tensile strength is not so great. However, when the density of the above number is between about 50 or more and 1500 or less, the change in tensile strength is great. In particular, when the density of the above number is 200 or more and 1350 or less, it can be seen that the tensile strength is easily improved. In this case, if the density of the above number is 1000 or less, and further 850 or less, it is easy to improve the tensile strength. When the relative density is 97% or more, the tensile strength becomes higher if the density of the above number is 250 or more and 850 or less, and further 300 or more and 500 or less. For these reasons, when the relative density is 93% or more and further 97% or more, if the compound particles of 0.3 μm or more are present appropriately, the coarseness of the crystal grains is reduced, and it is easy to obtain an improvement effect of the strength. Therefore, in order to improve the tensile strength of the fine sintered material having a relative density of 93% or more, it is desirable to contain the compound particles within a specific range.

(2) When the sintered material has the same relative density, if the density of the above number is 200 or more and 850 or less, the tensile strength of the sintered material can be increased (see Comparison between specific sample groups). For example, in this test, when the relative density is 97% or more, the tensile strength is 1750 MPa or more if the density of the number is in the above range. Many samples have a tensile strength of more than 1800 MPa. Some samples have a tensile strength greater than 1900 MPa.

(3) Reduction treatment of the iron-based powder (here, alloy powder) used for the raw material powder within the range of 800° C. to 950° C. can control the density of the above number. Here, if the temperature during the reduction treatment is within the above-described range, it is possible to produce a sintered material having the density of 200 or more and 1350 or less.

Based on the above, the sintered material in which compound particles having a relative density of 93% or more and a size of 0.3 μm or more in cross section are present within the above-described specific range has a high tensile strength, and in this respect, the sintered material has excellent strength. In addition, it has been shown that such a sintered material can be manufactured by sintering a compact with a relative density of 93% or more using an iron-based powder subjected to a reduction treatment at a specific temperature as a raw material.

The present invention is not limited to these examples and is intended to include all modifications within the meaning and scope of the claims and equivalents thereof. For example, the composition and manufacturing conditions of the sintered material may be changed in the above-described test example 1. Parameters that can be changed for manufacturing conditions include, for example, a heating temperature and a retention period in the reduction treatment, a sintering temperature, a sintering period, and atmosphere in sintering, and the like.

DESCRIPTION OF THE REFERENCE NUMERALS

1 sintered material
11 surface
12 measurement area
2 compound particle
3 teeth
30 tip of tooth
31 tooth flank
32 base of tooth
40 end face
41 through hole

The invention claimed is:

1. A sintered material, comprising:

a composition composed of iron-based alloy; and a texture containing 200 or more and 1350 or less of compound particles having a size of 0.3 μm or more per unit area of 100 μm×100 μm in a cross section, wherein a relative density is 93% or more, and wherein raw material powder of the sintered material contains iron-based alloy particles, wherein the iron-based alloy consists of Ni, Fe, impurities, and optionally one or more elements selected from the group consisting of C, Mo, Mn, Cr, B, and Si, and the compound particles include an oxide, a sulfide, a carbide, or a nitride of the one or more elements, Ni Fe, and the impurities, and wherein the iron-based alloy particles have a nickel content of from 0.1% to 4.0% by mass, and the iron-based alloy particles have a carbon content of from 0.1% to 2.0% by mass.

2. The sintered material according to claim 1, wherein the relative density is 97% or more.

3. The sintered material according to claim 1, wherein a number of the compound particles present per unit area is 200 or more and 850 or less.

4. The sintered material according to claim 1, wherein a number of the compound particles having the size of 0.3 μm or more per unit area is n, a number of the compound particles having a size of 20 μm or more per unit area is n20, a ratio of the number n20 to the number n is (n20/n)×100, and the ratio is 1% or less.

* * * * *